United States Patent [19]

Burns

[11] 4,001,734

[45] Jan. 4, 1977

[54] $\pi$-LOOP PHASE BIT APPARATUS

[75] Inventor: Richard W. Burns, Orange, Calif.

[73] Assignee: Hughes Aircraft Company, Culver City, Calif.

[22] Filed: Oct. 23, 1975

[21] Appl. No.: 625,271

[52] U.S. Cl. ..... 333/31 R; 333/7 D; 333/97 S

[51] Int. Cl.[2] ..... H01P 1/18; H01P 1/10; H03H 7/34

[58] Field of Search ..... 333/29, 31 R, 31 A, 333/7 R, 7 D, 84 R, 84 M, 97 R, 97 S; 307/256, 320

[56] References Cited

UNITED STATES PATENTS

| | | | |
|---|---|---|---|
| 3,131,367 | 4/1964 | Pitts et al. | 333/7 |
| 3,568,097 | 3/1971 | Hyltin | 333/7 D |
| 3,568,105 | 3/1971 | Felsenheld | 333/7 D X |

*Primary Examiner*—Alfred E. Smith
*Assistant Examiner*—Marvin Nussbaum
*Attorney, Agent, or Firm*—Robert H. Himes; W. H. MacAllister

[57] ABSTRACT

The use of electronically variable phase shifters is required in phased array radar systems. Diode phase shifters are particularly well suited for use in phased array radar systems because they have size and weight advantage over other types of phase shifting components such as ferrite devices and traveling wave tubes and, in addition, offer the potential of cost reductions through the application of batch processing techniques. In accordance with the present invention, a phase bit is provided by the appropriate forward or reverse biasing of one series and one shunt diode to switch between a $\pi$ circuit and a loop transmission line circuit shunting the equivalent capacitance of the series diode when reverse biased.

7 Claims, 3 Drawing Figures

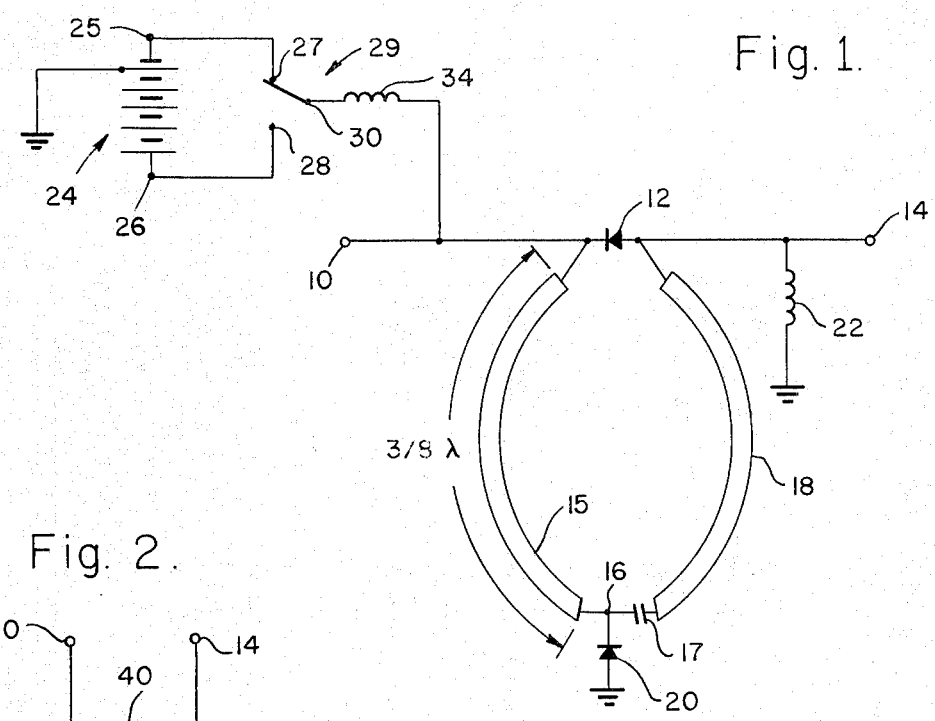
Fig. 1.
Fig. 2.
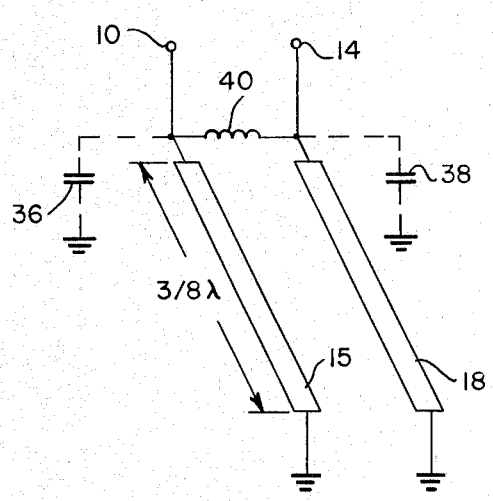
Fig. 3.
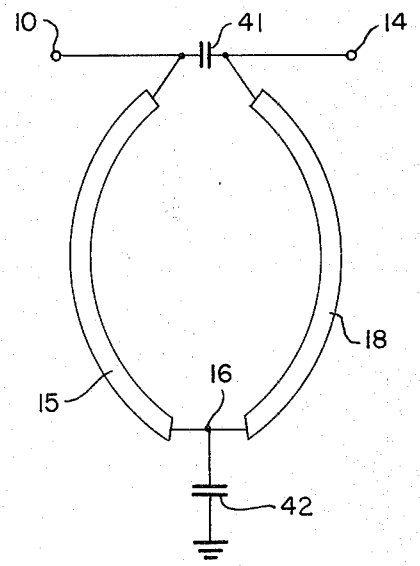

$\pi$-LOOP PHASE BIT APPARATUS

BACKGROUND OF THE INVENTION

Several types of diode phase shifters have been devised such as switched line, hybrid coupled, loaded line and three element "$\pi$" or "T" circuits. The switched line circuit includes a pair of single-pole, double-throw switches for switching one or two lengths of transmission line into a circuit. In general, this circuit requires four diodes. Phase shift is obtained by switching between one line used as a reference path and a second line which provides a delay path. The hybrid coupled circuit includes a 3 decibel hybrid with a pair of balanced diode switches connected to identical split arms of the hybrid. The hybrid coupled bit is used extensively because it achieves longer phase shifts while still using only two diodes. The loaded line circuit, on the other hand, includes a number of pairs of switched susceptances spaced at one quarter wavelength intervals along a transmission line. Phase shift is obtained as the susceptances are changed from an inductive to a capacitive state. Phase shift for this circuit is limited to about 45° for a pair of diodes. Lastly, the $\pi$-circuit consists of two shunt elements and one series element. Phase shift is obtained by changing the circuit elements between a low-pass and a high-pass condition. Phase shifts of the order of 90° can be obtained with this circuit. Three diodes are required for the "$\pi$" circuit and the "T" circuit which is a dual of the "$\pi$" circuit.

SUMMARY OF THE INVENTION

In accordance with the present invention, a $\pi$-loop phase bit is provided by a series diode having approximately three-fourths wavelength of transmission line connected in parallel therewith with an additional diode connected from the center thereof to ground. Operation is effected by forward biasing the diodes whereby a $\pi$ equivalent circuit is formed. In the reverse bias or opposite state, however, the shunt diode opens to allow a radio frequency signal to flow around the loop of transmission line. Part of the signal also flows through the reverse biased series diode. By adjusting the length of the loop and the impedance of the series path, matched transmission can be achieved in both bias states. Transformer sections at the input and output can also be used to match at the bit. The amount of phase shift can be adjusted by proper choice of diode reactances, impedance levels and line lengths in the loop.

BRIEF DESCRIPTION OF THE DRAWINGS

FIG. 1 illustrates a schematic circuit diagram of the $\pi$-Loop phase bit apparatus of the present invention;

FIG. 2 shows the equivalent circuit diagram of the apparatus of FIG. 1 when the series and shunt diodes are both forward biased; and FIG. 3 shows the equivalent circuit diagram of the apparatus of FIG. 1 when the series and shunt diodes are both reverse biased.

DESCRIPTION OF THE PREFERRED EMBODIMENTS

Referring to FIG. 1 there is depicted the $\pi$-loop phase bit apparatus of the present invention. In particular, an input terminal 10 is connected through a series diode 12 to an output terminal 14, the series diode 12 being poled to allow bias current flow in a direction towards the input terminal 10. In addition a three-eights wavelength segment of transmission line 15 is connected from input terminal 10 to a junction 16 which, in turn, is connected through a blocking capacitor 17 and a three-eights wavelength segment of transmission line 18 to the output terminal 14. Junction 16 is connected through a shunt diode 20 to ground and is poled to allow bias current to flow towards the junction 16. Further, the center conductor of the transmission line segment 18 is maintained at direct-current ground potential by means of a radio frequency bias choke 22 connected from the center conductor thereof to ground.

The operation of the device of FIG. 1 is not critically dependent on the radio frequency parameters of the diodes 12, 20 in that a wide range of diode parameters can be used to give radio frequency phase shift. By way of example, diodes with a capacitance of the order of 1.0 picofarads and a resistance of the order of 0.25 ohms have been found to be satisfactory for S-band and L-band applications. Also, diodes with a capacitance of the order of 0.8 picofarads have been found to be satisfactory for C-band applications.

Biasing the $\pi$-loop phase bit appartus of the present invention is accomplished by maintaining the input terminal 10 at an appropriate direct-current potential. The input terminal 10 is directly connected to the cathodes of both diodes 12, 20 and is blocked from the anode of diode 12 by blocking capacitor 17.

Biasing appartus includes, for example, a source of potential 24 which is referenced to ground so as to provide a potential of −0.75 volts at a negative terminal 25 and a potential of +100 volts at a positive terminal 26 thereof. Terminals 25, 26 of the source of potential 24 are connected to respective inputs 27, 28 of a double-throw single-pole switch 29 which is, in turn, connected from an output 30 thereof through a radio-frequency choke 32 to the input terminal 10. Position of the pole of switch 29 determines the bias applied to the diodes 12, 20; i.e., when the single-pole of switch 29 is in contact with terminal 27 thereof the diodes 12, 20 are forward biased by + 0.75 volts and when the single-pole of switch 25 is in contact with terminal 28 thereof the diodes 12, 20 are reverse biased by −100 volts.

Referring to FIG. 2, there is shown the equivalent circuit of the apparatus of FIG. 1 when the diodes 12, 20 are forward biased whereby bias current flows therethrough. Current flow through diode 20 effectively radio-frequency grounds junction 16 whereby transmission line segments 15, 18 reflect an impedance between infinity and zero to the input and output terminals 10, 14 respectively. Selection of the actual length and characteristic impedance of the transmission lines 15, 18 will determine the magnitude and type of this impedance. It is generally known that a short at the end of a one-quarter wavelength transmission line generates a very high impedance (theoretically infinite) at the input and that a short at the end of a half wavelength transmission line reflects a short at the input. Thus, a short at the end of a three-eights wavelength transmission line generates an impedance at the input that is a capacitive reactance between these extremes illustrated by capacitances 36, 38 connected from terminals 10, 14 to ground, respectively. The series diode 12, on the other hand, being forward biased, provides a slightly inductive path 40 connecting the terminals. The capacitances 36, 38 and inductance 40 from the $\pi$-network maintain proper impedance levels and produces phase shift between terminals 10 and 14.

Referring to FIG. 3, there is shown the equivalent circuit of the apparatus of FIG. 1 when the diodes are reverse biased, i.e. when the single-pole of switch 29 is thrown so as to connect terminals 28 and 30 thereby biasing the diodes 12, 20 with −100 volts. Under these circumstances the diodes 12, 20 present capacitances 41, 42, respectively, to the radio-frequency signal. A radio-frequency signal applied to input terminal 10 divides with one part flowing through the transmission line segments 15, 18 to the output terminal 14 and the remaining part flowing through capacitor 41 to the output terminal 14. These two signal parts recombine at the terminal 14 which results in the introduction of a phase shift between terminals 10 and 14. The net change in phase shift for the device is the difference in phase shift between terminals 10 and 14 when the diodes 12, 20 are in forward and reverse bias. The $\pi$-loop phase bit device described herein allows wide tolerance variation in diode 12, 10 parameters since the phase shift is achieved primarily by proper choice of lengths of the transmission line segments 15, 18 and impedance levels and is capable of operating over a bandwidth of the order of 20 to 30 percent. By proper choice of parameters of the diodes and transmission line segments, phase shifts from very low to comparatively high values (i.e. 180° ) can be achieved.

What is claimed is:

1. An apparatus for selectively introducing a predetermined phase shift in a signal, said apparatus comprising a signal input terminal and a signal output terminal, a first unidirectionally conducting device connected from said signal input terminal to said signal output terminal; a first segment of transmission line connected from said signal input terminal to a first junction, said first segment of transmission line being greater than one-quarter wavelength and less than one-half wavelength long at the frequency of said signal; a second segment of transmission line connected from said output terminal to said first junction, the length of said second segment of transmission line being substantially equal to that of said first segment; a second unidirectionally conducting device connected from said first junction to a second junction maintained at a substantially fixed direct-current reference potential; and means connected to said first and second segments of transmission line for simultaneously reverse biasing said first and second unidirectionally conducting devices to provide a reference phase shift in said signal or for simultaneously forward biasing said first and second unidirectionally conducting devices thereby to selectively increase said reference phase shift by said predetermined phase shift.

2. An apparatus for selectively introducing a predetermined phase shift in a signal, said apparatus comprising a signal input terminal and a signal output terminal; a first unidirectionally conducting device connected from said signal input terminal to said signal output terminal said first unidirectionally conducting device being poled in a predetermined direction in proceeding from said signal input terminal to said signal output terminal; a first segment of transmission line connected from said signal input terminal to a first junction, said first segment of transmission line being greater than one-quarter wavelength and less than one-half wavelength long at the frequency of said signal; a second segment of transmission line connected from said signal output terminal to said first junction, the length of said second segment of transmission line being substantially equal to that of said first segment; a second unidirectionally conducting device connected from said first junction to a second junction maintained at a substantially fixed direct-current reference potential and poled in said predetermined direction in proceeding from said first junction to said second junction; means coupled to said signal output terminal for maintaining the quiescent potential thereof at said substantially fixed direct-current reference potential; and means coupled to said signal input terminal for simultaneously reverse biasing said first and second unidirectionally conducting device to provide a reference phase shift in said signal or for simultaneously forward biasing said first and second unidirectionally conducting devices thereby to selectively increase said reference phase shift by said predetermined phase shift.

3. The apparatus for selectively introducing a predetermined phase shift in a signal as defined in claim 2 wherein said means coupled to said signal output terminal for maintaining the quiescent potential thereof at said substantially fixed direct-current reference potential includes a radio-frequency choke connected from said signal output terminal to said second junction and a blocking capacitor interconnected in said second segment of transmission line between said first junction and said signal output terminal.

4. The apparatus for selectively introducing a predetermined phase shift in a signal as defined in claim 2 wherein said first and second segments of transmission line are each equal to three-eighths wavelength long at the frequency of said signal.

5. An apparatus for selectively introducing a predetermined phase shift in a signal, said apparatus comprising a signal input terminal and a signal output terminal; a first diode connected from said signal input terminal to said signal output terminal, said first diode being poled in a direction to allow current flow towards said signal input terminal; a first segment of transmission line connected from said signal input terminal to a first junction, said first segment of transmission line being three-eighths wavelength at the frequency of said signal; a second segment of transmission line connected from said signal output terminal to said first junction, the length of said second segment of transmission line being substantially equal to that of said first segment; a second diode connected from said first junction to ground and poled to allow bias current flow towards said first junction; and means coupled to said first and second segments of transmission line for simultaneously reverse biasing said first and second diodes thereby to generate a reference phase shift in said signal or for simultaneously forward biasing said first and second diodes thereby to selectively increase said reference phase shift by said predetermined phase shift.

6. An apparatus for selectively introducing a predetermined phase shift in a signal, said apparatus comprising a signal input terminal and a signal output terminal, a first unidirectionally conducting device connected from said signal input terminal to said signal output terminal; a first segment of transmission line connected from said signal input terminal to a first junction, said first segment of transmission line being greater than one-quarter wavelength and less than one-half wavelength long at the frequency of said signal; a second segment of transmission line connected from said signal output terminal to said first junction, the length of said second segment of transmission line being substantially equal to that of said first segment; a second unidirectionally conducting device connected from said first junction to a second junction maintained at a substantially fixed direct-current reference potential; and means coupled to first and second unidirectionally conducting devices for simultaneously rendering said first and second unidirectionally conducting devices non-conductive to generate a reference phase shift in said signal or for simultaneously rendering said first and second unidirectionally conductive devices conductive thereby to selectively increase said reference phase shift by said predetermined phase shift.

7. The apparatus for selectively introducing a predetermined phase shift in a signal as defined in claim 6 wherein said predetermined phase shift is in the range of from 22.5° to 180°.

* * * * *